US008420968B2

(12) United States Patent
Park

(10) Patent No.: US 8,420,968 B2
(45) Date of Patent: Apr. 16, 2013

(54) SWITCHING MECHANISM CAPABLE OF INDICATING CONTACTS STATUS AND MOLD CASED CIRCUIT BREAKER HAVING THE SAME MECHANISM

(75) Inventor: Jin Young Park, Chungcheongbuk-Do (KR)

(73) Assignee: LS Industrial Systems Co., Ltd., Gyeonggi-Do (KR)

( * ) Notice: Subject to any disclaimer, the term of this patent is extended or adjusted under 35 U.S.C. 154(b) by 666 days.

(21) Appl. No.: 12/648,350

(22) Filed: Dec. 29, 2009

(65) Prior Publication Data

US 2010/0163382 A1 Jul. 1, 2010

(30) Foreign Application Priority Data

Dec. 31, 2008 (KR) ..... 10-2008-0138503

(51) Int. Cl.
*H01H 3/04* (2006.01)
*H01H 3/20* (2006.01)

(52) U.S. Cl.
USPC ..... 200/335; 200/401; 335/6; 335/21; 335/171; 335/172

(58) Field of Classification Search ..... 200/335
See application file for complete search history.

(56) References Cited

U.S. PATENT DOCUMENTS 6,166,344 A 12/2000 Castonguay
7,843,290 B2 * 11/2010 Song et al. ..... 335/6

(Continued)

FOREIGN PATENT DOCUMENTS

CN 101038833 9/2007
DE 19841685 3/2000
EP 1039499 9/2000

OTHER PUBLICATIONS

China Office action, mail date is Mar. 29, 2012.
Search report from E.P.O, mail date is Oct. 19, 2012.

*Primary Examiner* — Renee S Luebke
*Assistant Examiner* — Lheiren Mae Caroc
(74) *Attorney, Agent, or Firm* — Greenblum & Bernstein P.L.C.

(57) ABSTRACT

Disclosed is a switching mechanism for a mold cased circuit breaker, capable of indicating a contacts status by a position of a handle. The switching mechanism comprises a handle; a lever providing a rotation supporting point of the handle; a shaft configured to rotatably support a movable contactor; a trip spring having an upper end supported by the handle, and configured to indicate a melt-adhered state of contacts by manipulating the handle to a TRIP position from an OFF position since a horizontal position of a lower end supporting point thereof in the TRIP position is discordant with a horizontal position of a rotation supporting point of the lever; a latch configured to restrict the trip spring; an upper link and a lower link; a toggle pin configured to support a lower end of the trip spring so as to provide the lower end supporting point; a latch holder; a nail rotatable to a position to restrict or release the latch holder; and an isolation lever having one end connected to the shaft and another end contactable to the nail, pressed by the lever by being upwardly moved so as to contact the lever, and configured to push the nail to a position to release the latch holder when manipulating the handle to an OFF position in a state that the contact of the movable contactor and the contact of the fixed contactor are melt-adhered to each other.

6 Claims, 4 Drawing Sheets

U.S. PATENT DOCUMENTS

2006/0086693 A1 4/2006 Yeon
2006/0131145 A1 6/2006 Suh
2007/0215577 A1 9/2007 Park
2010/0018846 A1 1/2010 Bae

* cited by examiner

SWITCHING MECHANISM CAPABLE OF INDICATING CONTACTS STATUS AND MOLD CASED CIRCUIT BREAKER HAVING THE SAME MECHANISM

CROSS-REFERENCE TO A RELATED APPLICATION

Pursuant to 35 U.S.C. §119(a), this application claims the benefit of earlier filing date and right of priority to Korean Application 10-2008-0138503, filed on Dec. 31, 2008, the content of which is incorporated by reference herein in its entirety.

BACKGROUND OF THE INVENTION

1. Field of the Invention

The present invention relates to a mold cased circuit breaker, and particularly, to a mold cased circuit breaker having a switching mechanism capable of indicating a melt-adhered state of contacts by a position of a handle.

2. Background of the Invention

A mold cased circuit breaker is an electric device capable of protecting an electric circuit by automatically breaking the circuit in the occurrence of overloads or short-circuits.

The mold cased circuit breaker comprises a terminal configured to provide circuit connection terminal between an electrical power source and an electric load, a switching mechanism configured to provide driving force to open or close contacts, and a trip mechanism configured to trigger the switching mechanism so as to operate the switching mechanism to an open position (TRIP position) when an overcurrent or a current to instantaneously tripped or a short-circuit current is detected.

SUMMARY OF THE INVENTION

Therefore, an object of the present invention is to provide a mold cased circuit breaker capable of indicating a melt-adhered state of contacts by a position of a handle, by operating a switching mechanism to a TRIP position, and by manipulating (in other words driving) a handle so as to indicate the TRIP position when a user manipulates a handle to a RESET position (OFF position) without recognizing a melt-adhered state of contacts.

Another object of the present invention is to provide a switching mechanism for a mold cased circuit breaker capable of indicating a melt-adhered state of contacts by a position of a handle, by operating a switching mechanism to a TRIP position, and by manipulating (in other words driving) a handle so as to indicate the TRIP position when a user manipulates a handle to a RESET position (OFF position) without recognizing a melt-adhered state of contacts.

To achieve these and other advantages and in accordance with the purpose of the present invention, as embodied and broadly described herein, there is provided a mold cased circuit breaker, comprising: a fixed contactor electrically connectable to an electrical power source or an electrical load, and having a contact; a movable contactor rotatable to a position contacting the fixed contactor or a position separated from the fixed contactor, and having a contact corresponding to the contact of the fixed contactor; a shaft configured to support the movable contactor, and to rotatably drive the movable contactor; a handle configured to manually rotate the shaft to an ON position that the contact of the movable contactor contacts the contact of the fixed contactor, or an OFF position that the contact of the movable contactor is separated from the contact of the fixed contactor; a lever rotatably connected to the handle, and providing a rotation supporting point of the handle; a trip spring capable of driving the circuit breaker to a TRIP position that the contact of the movable contactor is separated from the contact of the fixed contactor, by rotating the shaft by using elastic energy charged thereto, having an upper end supported by the handle, and configured to indicate a melt-adhered state of contacts by manipulating the handle to the TRIP position since a horizontal position of a lower end supporting point thereof in the TRIP position is discordant with a horizontal position of a rotation supporting point of the lever; a latch configured to restrict the trip spring in a charging status of elastic energy; a latch holder rotatable to a position to restrict the latch or a position to release the latch; a nail rotatable to a position to restrict the latch holder, or a is position to release the latch by releasing the latch holder; and an isolation lever having one end connected to the shaft and another end contactable to the nail, pressed by the lever by being upwardly moved so as to contact the lever, and configured to push the nail to a position to release the latch holder when manipulating the handle to the OFF position in a state that the contact of the movable contactor and the contact of the fixed contactor are melt-adhered to each other.

To achieve these and other advantages and in accordance with the purpose of the present invention, as embodied and broadly described herein, there is also provided a switching mechanism for a mold cased circuit breaker comprising: a fixed contactor electrically connectable to an electrical power source and an electrical load of a circuit, and having a contact; a movable contactor rotatable to a position contacting the fixed contactor or a position separated from the fixed contactor; and a shaft configured to rotatably support the movable contactor, the switching mechanism comprising: a handle configured to manually operate the circuit breaker to an ON position or an OFF position; a lever connected to the handle so as to provide a rotation supporting point of the handle; a trip spring capable of driving the circuit breaker to a TRIP position that the contact of the movable contactor is separated from the contact of the fixed contactor, by rotating the shaft by using elastic energy charged thereto, having an upper end supported by the handle, and configured to indicate a melt-adhered state of contacts by manipulating the handle to the TRIP position since a horizontal position of a lower end supporting point thereof in the TRIP position is discordant with a horizontal position of a rotation supporting point of the lever; a latch configured to restrict the trip spring in a charging status of elastic energy; an upper link having one end connected to the latch; a lower link having an upper end connected to the upper link, and having a lower end connected to the shaft; a toggle pin configured to connect the upper link and the lower link to each other, and configured to support a lower end of the trip spring so as to provide the lower end supporting point; a latch holder rotatable to a position to restrict the latch or a position to release the latch; a nail rotatable to a position to restrict the latch holder, or a position to release the latch by releasing the latch holder; and an isolation lever having one end connected to the shaft and another end contactable to the nail, pressed by the lever by being upwardly moved so as to contact the lever, and configured to push the nail to a position to release the latch holder the nail when manipulating the handle to the OFF position in a state that the contact of the movable contactor and the contact of the fixed contactor are melt-adhered to each other.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE INVENTION

Figure 1:
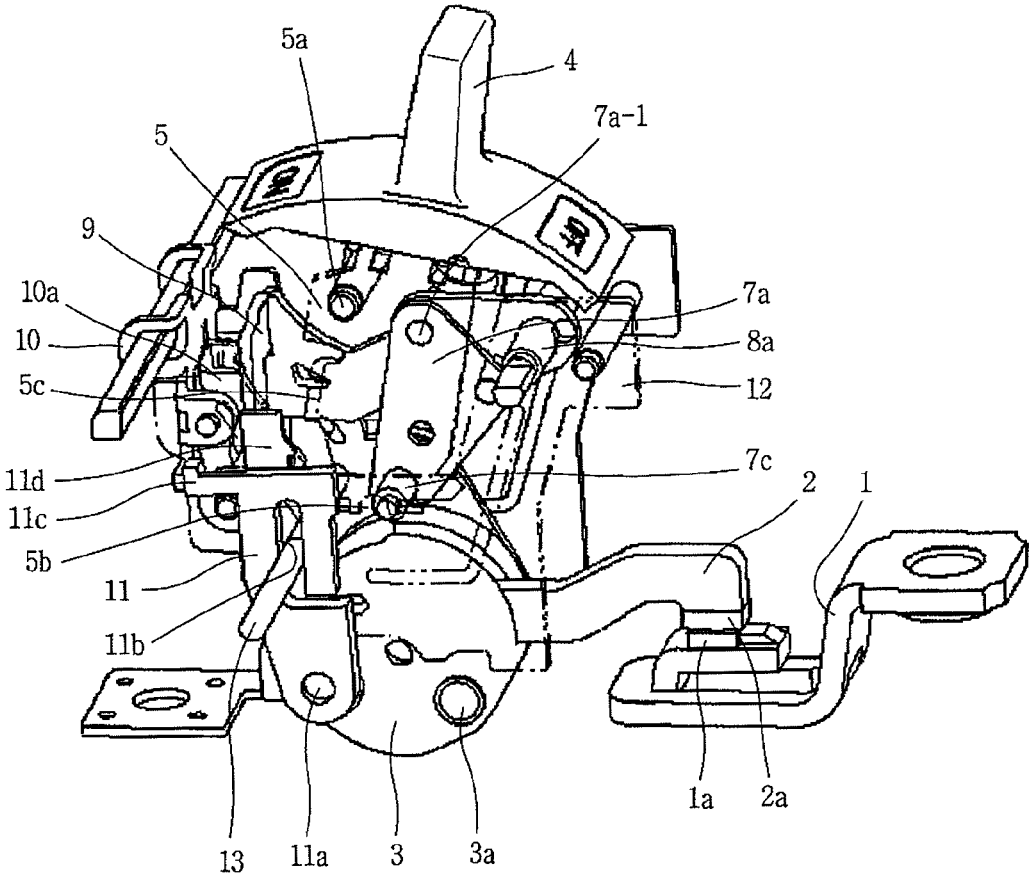
FIG. 1 is a perspective view showing a configuration of a switching mechanism for a mold cased circuit breaker according to the present invention.

Description will now be given in detail of the present invention, with reference to the accompanying drawings.

A switching mechanism for a mold cased circuit breaker, and a mold cased circuit breaker having the switching mechanism according to the present invention will be explained in more detail with reference to FIGS. 1 and 2.

The mold cased circuit breaker according to the present invention comprises a fixed contactor 1 electrically connectable to an electrical power source or an electrical load, and having a contact 1*a* fixed to one end thereof; a movable contactor 2 rotatable to a position contacting the fixed contactor 1 or a position separated from the fixed contactor 1, and having a contact 2*a* corresponding to the contact 1*a* of the fixed contactor 1; a shaft 3; a lower casing (not shown) formed in a rectangular shape and having an opened upper surface for accommodating therein a switching mechanism, and components of the mold cased circuit breaker are accommodated; and an upper cover (not shown) configured to cover the lower casing.

The shaft 3 supports the movable contactor 2, and rotatably drives the movable contactor 2 to an open position or a closing position by elastic energy discharged from a trip spring 6 to be later explained. The elastic energy is transmitted to the shaft 3 through a toggle pin 7*c* and a lower link 7*b* by which a lower end of the trip spring 6 is supported, thereby rotating the shaft 3 in an open direction (counterclockwise direction in FIGS. 1 and 2), or in a closing direction (clockwise direction in FIGS. 1 and 2). The mold cased circuit breaker for industrial purposes is used for a three-phase alternating current. Accordingly, the fixed contactor 1 and the movable contactor 2 of the mold cased circuit breaker are provided in three in number, respectively, in correspondence to three phases. And, the shaft 3 configured to support the movable contactor 2 is also provided in three in number in correspondence to three phases (so called R phase, S phase and T phase). The shafts 3 for three phases are driven so as to be simultaneously rotated to an open direction or a closing direction by a shaft pin 3*a* penetratingly connected with the three shafts 3.

The switching mechanism for the industrial mold cased circuit breaker according to the present invention is implemented as one switching mechanism is provided on the shaft 3 for an S-phase as a common driving unit for three phases. Accordingly, the shafts 3 for three phases are simultaneously driven through the shaft pin 3*a* in an open direction or a closing direction. The switching mechanism for the mold cased circuit breaker according to the present invention comprises a handle 4, a lever 5, a trip spring (in other words main spring) 6, an upper link 7*a*, a lower link 7*b*, a toggle pin 7*c*, a latch 8, a latch holder 9, a nail 10, and an isolation lever 11. The switching mechanism for the mold cased circuit breaker according to the present invention further comprises a side plate 12 configured to provide supporting substrates of both sides so as to support components of the switching mechanism, and a guide pin fixed to the side plate 12 and for guiding up-down motion of the isolation lever 11.

The handle 4 serves to manually rotate the shaft 3 to an ON position that the contact 2*a* of the movable contactor 2 contacts the contact 1*a* of the fixed contactor 1, or an OFF position that the contact 2*a* of the movable contactor 2 is separated from the contact 1*a* of the fixed contactor 1.

The lever 5 is configured in one pair so as to support the handle 4 at both sides. Each of the levers 5 is rotatably connected to a lower part of the handle 4, and provides a rotation supporting point of the handle 4. That is, lower ends of the one pair of levers 5 have a shaft receiving portion having a semi-circular groove in correspondence to a semi-circular rotation shaft portion (not shown) disposed at a central lower part of the side plate 12. The shaft receiving portion provides the rotation supporting point of the handle 4. At a middle part of the lever 5 in a length direction, disposed is an isolation lever pressing portion 5*c* configured to rotate the isolation lever 11 by pushing an upper part of the isolation lever 11 to the nail 10 when the handle 4 is manipulated to a RESET position (OFF position).

The trip spring (main spring) 6 maybe implemented as a coil spring having an upper end supported by the handle 4, and having a lower end supported by the toggle pin 7*c*. Referring to FIG. 2, in a RESET position of the mold cased circuit breaker, i.e., in a position that the handle 4 has been manipulated to the OFF position, the upper link 7*a* and the lower link 7*b* are in a nearly vertically-unfolded state. Here, the toggle pin 7*c* is located at a lower side in a vertical direction. Accordingly, the trip spring 6 becomes extended to charge elastic energy. In the RESET position, the latch 8 is restricted by a restriction groove (not shown) disposed at the latch holder 9. This may allow the trip spring 6 to maintain its charged state with elastic energy. Accordingly, even if a user manipulates the handle 4 to the ON position, the trip spring 6 maintains its charged state with elastic energy because the latch 8 is in a restricted state by the latch holder 9. However, when the latch 8 is released from the latch holder 9 (during trip operation), the trip spring 6 is contracted to the original state thereby to discharge the elastic energy charged thereto. As a lower end of the trip spring 6 upwardly pulls the toggle pin 7*c*, the upper link 7*a* and the lower link 7*b* are in a folded status. Accordingly, the shaft 3 connected to the lower link 7*b* through the shaft pin 3*a* is rotated in a counterclockwise direction in FIG. 2. As the trip spring 6 rotates the shaft 3 by using the elastic energy charged thereto, the mold cased circuit breaker may be automatically operated to a TRIP position that the contact 2*a* of the movable contactor 2 is separated from the contact 1*a* of the fixed contactor 1. This operation to automatically open an electric circuit by the mold cased circuit breaker is referred to as a TRIP operation, and the position of the mold cased circuit breaker which is in the TRIP operation is referred to as a TRIP position rather than the ON position or the OFF position. In the TRIP position, a horizontal position of a lower end supporting point of the trip spring 6, i.e., a horizontal position of the toggle pin 7*c* is moved to the left side of FIGS. 1 and 2 as the upper link 7*a* and the lower link 7*b* are folded to each other. However, a lower end supporting point of the handle 4, i.e., a rotation supporting point 5*b* of the lever 5 is in a fixed position together with the rotation shaft portion (not shown) of the side plate 12. Accordingly, the lower end supporting point of the trip spring 6, i.e., a horizontal position of the toggle pin 7*c* is discordant with a horizontal position of the rotation supporting point 5*b* of the lever 5.

Accordingly, even if the handle 4 is manipulated to the OFF position after the trip operation, the handle 4 may be driven to a central upper position, a position when the handle 4 is in the TRIP status, by a restoration force of the trip spring 6 to the straightened state from the bent state when the handle 4 is released. In the ON position, the handle 4 is moved to the right side in FIG. 1 to indicate an upper side inclined to the right side. On the other hand, in the OFF position, the handle 4 is moved to the left side in FIG. 1 to indicate an upper side inclined to the left side. As the isolation lever 11 operates the latch holder 9 to a position to release the latch 8 by pushing the nail 10, the lower end supporting point of the trip spring 6, i.e., a horizontal position of the toggle pin 7*c* is discordant with a horizontal position of the rotation supporting point 5*b* of the lever 5. Accordingly, even if the handle 4 is manipulated to the OFF position, the trip spring 6 transmits a restoration force to the straightened state from the bent state to the handle 4 connected to an upper end of the trip spring 6 when the handle 4 is released. This may allow the handle 4 to rotate to the TRIP position, thereby indicating that the mold cased circuit breaker is in a melt-adhered state of the contacts.

The latch 8 may be configured to restrict the trip spring 6 charged with elastic energy or discharging the elastic energy. Restricting or releasing of the latch 8 may be implemented by the latch holder 9 rotatable to a position to restrict or release the latch 8. This will be explained in more detail.

As shown in FIG. 1, the latch 8 is rotatably supported by a latch pin 8*a*. In order to manually manipulate the mold cased circuit breaker which is in the TRIP status as shown in FIG. 5 to the ON position, the switching mechanism for the mold cased circuit breaker has to be reset. This reset operation may be performed by manipulating the handle 4 to the OFF position shown in FIG. 4.

Figure 3:
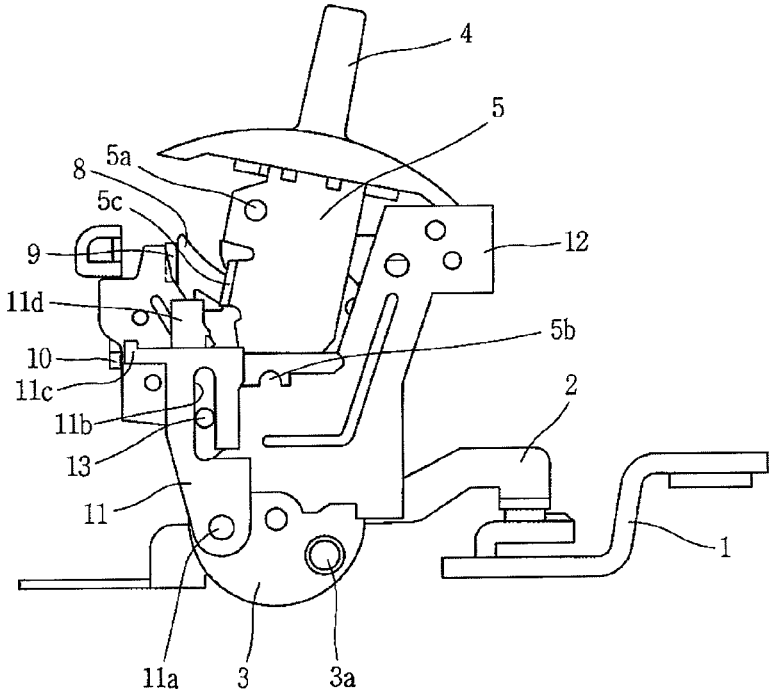
FIG. 3 is a side sectional view showing an operational status (ON status) of the switching mechanism for a mold cased circuit breaker according to the present invention.
Figure 4:
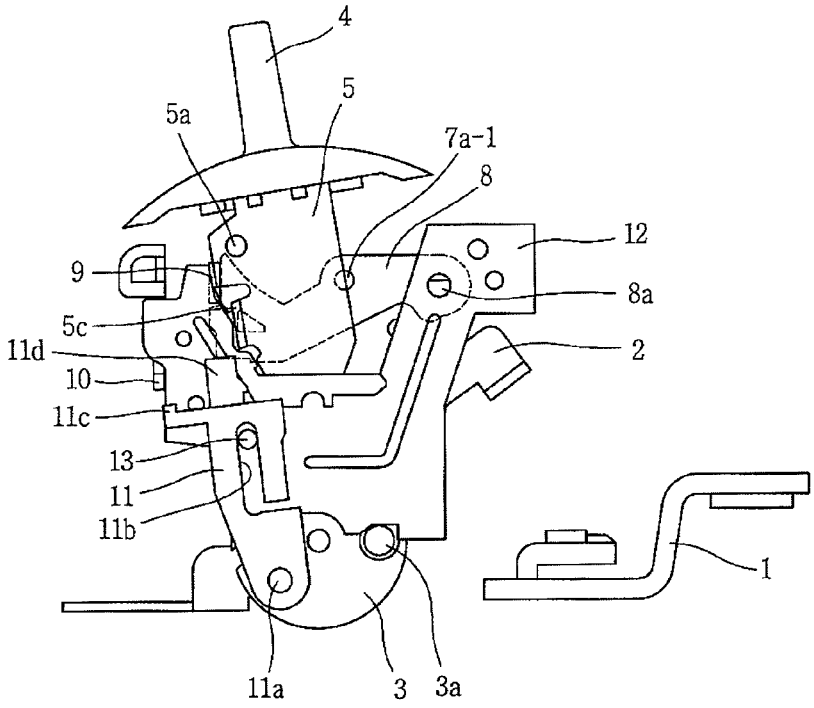
FIG. 4 is a side sectional view showing an operational status (OFF status) of the switching mechanism for a mold cased circuit breaker according to the present invention.
Figure 5:
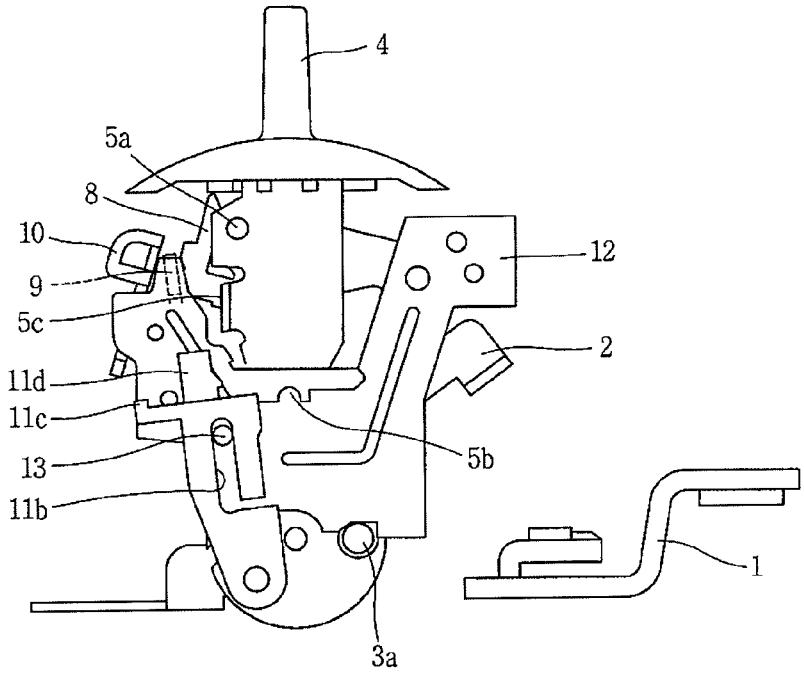
FIG. 5 is a side sectional view showing an operational status (TRIP status) of the switching mechanism for a mold cased circuit breaker according to the present invention.

Once the handle is counterclockwise rotated to the OFF position shown in FIG. 4, a reset pin 5*a* penetratingly installed on an upper part of the lever 5 connected to a lower end of the handle 4 and rotated in the same direction as the handle 4 is also counterclockwise rotated. Here, the reset pint 5*a* presses a left upper end of the latch 8, and thus the latch 8 is counterclockwise rotated centering around the latch pin 8*a* as can be indicated by the status in FIG. 2 from the status in FIG. 5. Accordingly, a stepped portion disposed at a left middle side of the latch 8 of FIG. 5 is locked by the restriction groove (not shown) formed in correspondence to the latch holder 9 of FIG. 1. Here, the upper link 7*a* connected to an upper side of the latch 8 in a length direction by a connection pin 7*a*-1 is downwardly moved according to the counterclockwise rotation of the latch 8. As the toggle pin 7*c* connected to a lower end of the upper link 7*a* is downwardly moved, the trip spring 6 becomes extended to charge elastic energy. As the latch 8 is restricted by the latch holder 9, the trip spring 6 maintains its charged status with elastic energy. That is, even if the handle 4 is manipulated to the ON position shown in FIGS. 2 and 3, from the RESET position (OFF position) shown in FIG. 4, a vertical position of the lower end of the upper link 7*a* in a state that the latch 8 is restricted by the latch holder 9, i.e., a vertical position of the toggle pin 7*c* is not changed. Accordingly, the trip spring 6 maintains its charged status with elastic energy.

However, once the latch 8 is released by a counterclockwise direction of the latch holder 9, the current status of the trip spring 6 is converted into a contracted status from an extended status (i.e., discharging status), thereby upwardly pulling the toggle pin 7*c* which supports a lower end of the trip spring 6. Accordingly, the upward motion of the toggle pin 7*c* causes the upper link 7*a* to be upwardly moved, and causes the latch 8 connected to the upper link 7*a* by the connection pin 7*a*-1 to be clockwise rotated.

The latch holder 9 is rotatable to a position to restrict the latch 8 and to a position to release the latch 8. More specifically, the latch holder 9 is elastically biased so as to be counterclockwise rotated by a bias spring (not shown). Here, the nail 10 supports the latch holder 9 at a left rear side lest should the latch holder 9 is not counterclockwise rotated. In this state, the latch holder 9 is located at a position to restrict the latch 8.

On the other hand, once the nail 10 is clockwise rotated to release the latch holder 9, the latch holder 9 is counterclockwise rotated by the bias spring to be located at a position to release the latch 8.

The nail 10 is rotatable to a position to restrict the latch holder 9 or to a position to release the latch 8 by releasing the latch holder 9. More specifically, the nail 10 is elastically biased so as to be clockwise rotated by a bias spring such as a torsion spring. The nail 10 includes a latch holder supporting portion 10*a* protruding toward the latch holder 9. And, the nail 10 supports the latch holder 9 at a let rear side of the latch holder 9 through the latch holder supporting portion 10*a*, by an elastic bias force from the bias spring, so that the latch holder 9 can not be counterclockwise rotated. In this state, the latch holder 9 is located at a position to restrict the latch 8.

On the other hand, once the nail 10 is clockwise rotated to release the latch holder 9, the latch holder 9 is counterclockwise rotated by the bias spring to be located at a position to release the latch 8.

The isolation lever 11 has one end connected to the shaft 3, and another end contactable to the nail 10. Also, the isolation lever 11 is provided with a guide long hole portion 11*b* configured to be guided up-down motion of the isolation lever 11 by a guide pin 13 fixed to the side plate 12. The guide long hole portion 11*b* is formed in a vertical direction. And, the isolation lever 11 is provided thereon with a lever contact portion 11*d* contacting the isolation lever pressing portion 5*c* of the lever 5. Under this configuration, when the shaft 3 of FIG. 1 is clockwise rotated, the isolation lever 11 is in an upwardly-moved position under guide of the guide long hole portion 11*b* by the guide pin 13 fixed to the side plate 12. On the other hand, when the shaft 3 of FIG. 1 is counterclockwise rotated, the isolation lever 11 is in a downwardly-moved position under guide of the guide long hole portion 11*b* by the guide pin 13 fixed to the side plate 12. Another end of the isolation lever 11, which is contactable to the nail 10 will be referred to as a nail pressing portion 11*c*.

The operation of the switching mechanism, and the mold cased circuit breaker having the switching mechanism according to the present invention will be explained.

Figure 2:
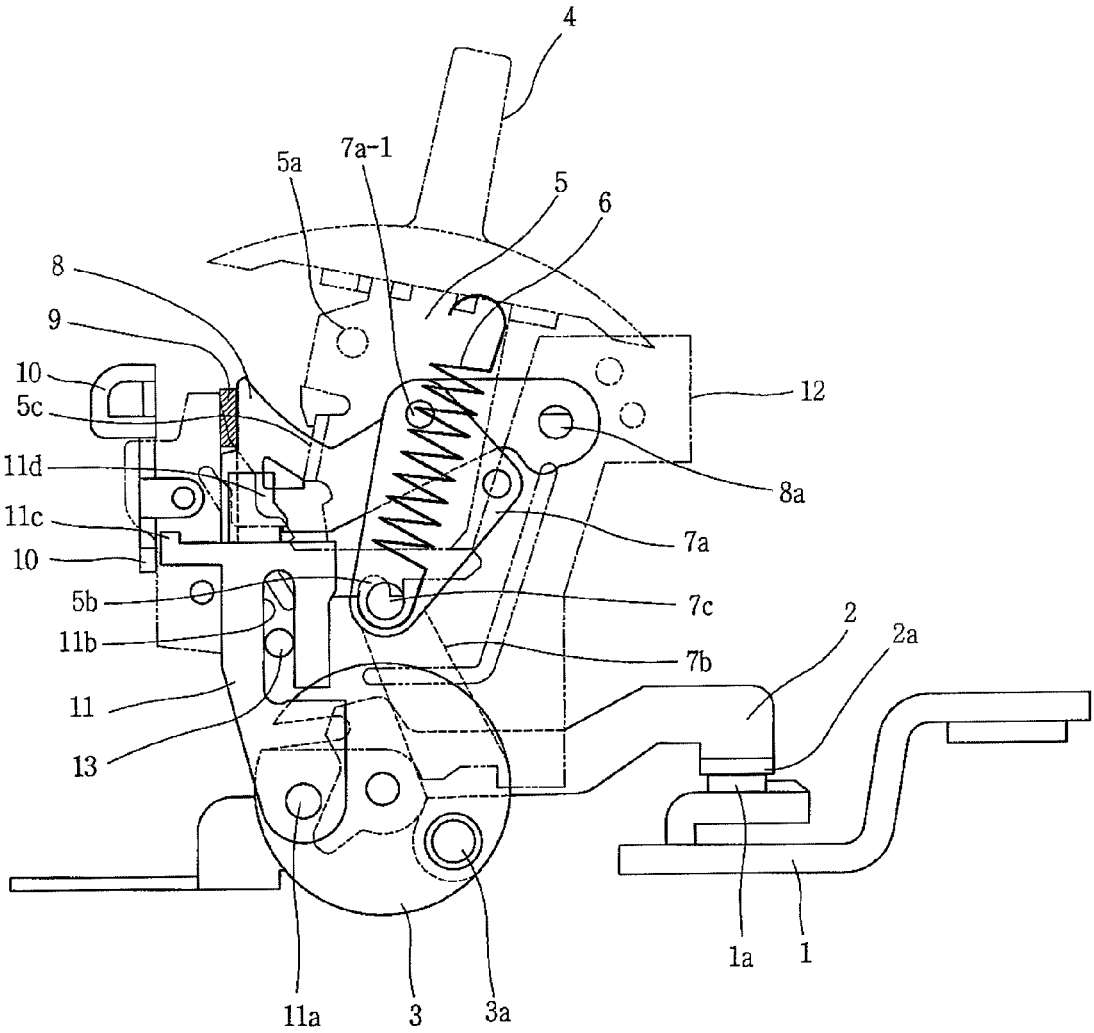
FIG. 2 is a side sectional view showing a configuration of the switching mechanism (ON status) for a mold cased circuit breaker according to the present invention.

When the handle 4 is manipulated to the ON position shown in FIGS. 1 to 3 from the OFF position shown in FIG. 4, a horizontal position of the toggle pin 7*c* is moved to the right side along an upper supporting point connected to the handle 4 having rotated to a clockwise direction (right direction) by an elastic restoration force of the trip spring 6 to maintain the straightened status in a state that a vertical position of the toggle pin 7*c* is scarcely changed. Accordingly, as shown in FIGS. 1 to 3, the upper link 7*a* and the lower link 7*b* are in an unfolded status, and the shaft 3 is clockwise rotated. This causes the isolation lever 11 to be upwardly moved as shown in FIGS. 1 to 3, which may be checked by a fact that the guide pin 13 fixed to the side plate 12 is located at a lower end of the guide long hole portion 11*b* in FIGS. 1 to 3.

On the other hand, when the handle 4 is counterclockwise rotated to the OFF position shown in FIG. 4 from the ON position shown in FIGS. 1 to 3, a horizontal position of the toggle pin 7*c* is moved to the left side along an upper supporting point connected to the handle 4 having rotated to a counterclockwise direction (left direction) by an elastic restoration force of the trip spring 6 to maintain the straightened status in a state that a vertical position of the toggle pin 7*c* is scarcely changed. Accordingly, a lower end of the lower link 7*b*, which is connected to the shaft 3 is counterclockwise rotated, and thus the shaft 3 is counterclockwise rotated. According to the counterclockwise rotation of the shaft 3, the movable contactor 2 is separated from the fixed contactor 1, and the isolation lever 11 is downwardly moved as shown in FIG. 4. This may be checked by a fact that the guide pin 13 fixed to the side plate 12 is located at an upper end of the guide long hole portion 11*b* in FIG. 4. Here, the nail pressing portion 11*c* of the isolation lever 11 can not press the nail 10 since it is downwardly spacing from a position to press the nail 10. Furthermore, since the lever contact portion 11*d* of the isolation lever 11 is downwardly spacing from the isolation lever pressing portion 5*c*, the isolation lever 11 can not be pressed to be rotated by the lever 5.

In a state that the contact 2*a* of the movable contactor 2 and the contact 1*a* of the fixed contactor 1 are melt-adhered to each other due to flow of a large short-circuit current in the ON state, the mold cased circuit breaker automatically performs a trip operation. Accordingly, the handle 4 may indicate the TRIP position shown in FIG. 5, or the ON position shown in FIGS. 1 to 3.

Figure 6:
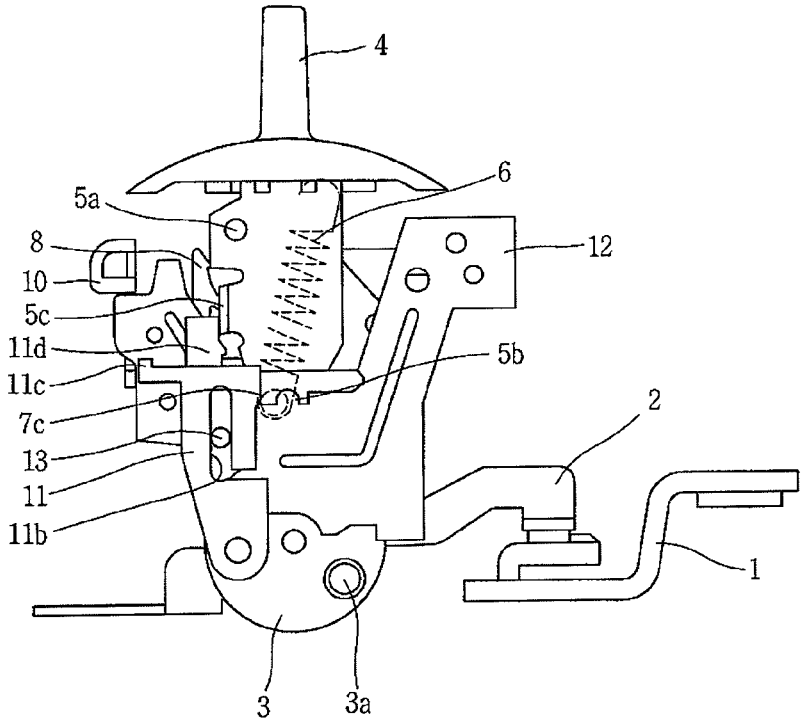
FIG. 6 is a side sectional view showing a melt-adhered state of contacts in the switching mechanism for a mold cased circuit breaker according to the present invention.

However, under this state that the contact 2*a* of the movable contact 2 and the contact 1*a* of the fixed contact 1 are melt-adhered to each other, breaking of the circuit is not substantially performed, but the shaft 3 is in the ON position as shown in FIG. 6. Since this position is same as the position of the shaft 3 in the ON position, the isolation lever 11 is in an upwardly-moved position as shown in FIG. 6. Besides, the nail pressing portion 11*c* of the isolation lever 11 is in a position to press the nail 10, and the lever contact portion 11*d* of the isolation lever 11 is in a position to contact the isolation lever pressing portion 5*c* of the lever 5. Under this state, once the user manipulates the handle 4 to the OFF position so as to reset the mold cased circuit breaker, the isolation lever pressing portion 5*c* of the lever 5 presses the lever contact portion 11*d* of the isolation lever 11 as shown in FIG. 6. Accordingly, the isolation lever 11 is counterclockwise rotated. As the nail pressing portion 11*c* of the isolation lever 11 counterclockwise rotates the nail 10 in a push manner, the latch holder 9 is operated to a releasing position. Accordingly, the latch holder 9 is counterclockwise rotated by an elastic force from the bias spring (not shown), thereby releasing the latch 8. As a result, the trip spring 6 discharges the elastic energy while being contracted to the original state. As a lower end of the trip spring 6 upwardly pulls the toggle pin 7*c*, the upper link 7*a* and the lower link 7*b* are in a folded state, and thus the shaft 3 connected to the lower link 7*b* by the shaft pin 3*a* is counterclockwise rotated in FIG. 6. As shown in FIGS. 1 and 2, the trip spring 6 counterclockwise rotates the shaft 3 by using elastic energy charged thereto, thereby operating the mold cased circuit breaker to a TRIP position that the contact 2*a* of the movable contactor 2 is separated from the contact 1*a* of the fixed contactor 1. However, due to the melt-adhered state of the contacts, the contact 2*a* of the movable contactor 2 fails to be separated from the contact 1*a* of the fixed contactor 1. In the TRIP position, a lower end supporting point of the trip spring 6, i.e., a horizontal position of the toggle pin 7*c* is moved to the left side of FIGS. 1 and 2 as the upper link 7*a* and the lower link 7*b* are folded to each other. However, a lower end supporting point of the handle 4, i.e., a rotation supporting point 5*b* of the lever 5 is in a fixed position together with the rotation shaft portion (not shown) of the side plate 12. Accordingly, the lower end supporting point of the trip spring 6, i.e., a horizontal position of the toggle pin 7*c* is discordant with a horizontal position of the rotation supporting point 5*b* of the lever 5. Accordingly, even if the handle 4 is manipulated to the OFF position after the trip operation, the handle 4 may be driven to a central upper position, a position when the handle 4 is in the TRIP status, by a restoration force of the trip spring 6 to the straightened state from the bent state when the handle 4 is released. The lower end supporting point of the trip spring 6, i.e., the horizontal position of the toggle pin 7*c* is discordant with the horizontal position of the rotation supporting point 5*b* of the lever 5. Accordingly, even if the handle 4 is manipulated to the OFF position, the trip spring 6 transmits a restoration force to the straightened state from the bent state to the handle 4 connected to an upper end of the trip spring 6 when the handle 4 is released. This may allow the handle 4 to rotate to the TRIP position, thereby indicating that the mold cased circuit breaker is in a melt-adhered state of the contacts.

The isolation lever 11 is formed of an elastic material, e.g., natural resin or artificial resin having elasticity, thereby pushing the nail 10 in a rotation manner by being bent when being pressed, and restoring to the original position when the pressure disappears.

The mold cased circuit breaker having the switching mechanism according to the present invention comprises the isolation lever located at a position to contact the lever by being upwardly moved in the ON status. Accordingly, once the user manipulates the handle to the RESET position (OFF position) in a melt-adhered state of the contacts, the switching mechanism is operated to the TRIP position as the isolation lever pressed by the lever rotates the nail in a pushing manner. As a result, the position of the toggle pin is discordant with the rotation supporting point of the lever in a horizontal direction. As the handle indicates the TRIP position by an elastic force of the trip spring, the melt-adhered state of the contacts may be indicated by the handle.

The mold cased circuit breaker having the switching mechanism according to the present invention comprises the guide pin fixed to the side plate and guiding up and down motion of the isolation lever. Accordingly, up and down motion of the isolation lever may be precisely guided.

In the mold cased circuit breaker having the switching mechanism according to the present invention, the isolation lever is provided with the guide long hole portion. This may allow up and down motion of the isolation lever to be precisely guided by the guide pin.

In the mold cased circuit breaker having the switching mechanism according to the present invention, the isolation lever is formed of an elastic material. This may allow the isolation lever to push the nail by being bent when being pressed, and to restore to the original position when the pressure applied thereto disappears.

The foregoing embodiments and advantages are merely exemplary and are not to be construed as limiting the present disclosure. The present teachings can be readily applied to other types of apparatuses. This description is intended to be illustrative, and not to limit the scope of the claims. Many alternatives, modifications, and variations will be apparent to those skilled in the art. The features, structures, methods, and other characteristics of the exemplary embodiments described herein may be combined in various ways to obtain additional and/or alternative exemplary embodiments.

As the present features may be embodied in several forms without departing from the characteristics thereof, it should also be understood that the above-described embodiments are not limited by any of the details of the foregoing description, unless otherwise specified, but rather should be construed broadly within its scope as defined in the appended claims, and therefore all changes and modifications that fall within the metes and bounds of the claims, or equivalents of such metes and bounds are therefore intended to be embraced by the appended claims.

What is claimed is:

1. A mold cased circuit breaker, comprising:

a fixed contactor electrically connectable to an electrical power source or an electrical load, and having a contact;

a movable contactor rotatable to a position contacting the fixed contactor or a position separated from the fixed contactor, and having a contact corresponding to the contact of the fixed contactor;

a shaft configured to support the movable contactor, and to rotatably drive the movable contactor;

a handle configured to manually rotate the shaft to an ON position that the contact of the movable contactor contacts the contact of the fixed contactor, or an OFF position that the contact of the movable contactor is separated from the contact of the fixed contactor;

a lever rotatably connected to the handle, and providing a rotation supporting point of the handle;

a trip spring capable of driving the circuit breaker to a TRIP position that the contact of the movable contactor is separated from the contact of the fixed contactor, by rotating the shaft by using elastic energy charged thereto, having an upper end supported by the handle, and configured to indicate a melt-adhered state of contacts by manipulating the handle to the TRIP position since a horizontal position of a lower end supporting point thereof in the TRIP position is discordant with a horizontal position of a rotation supporting point of the lever;

a latch configured to restrict the trip spring in a charged state with elastic energy;

a latch holder rotatable to a position to restrict the latch or a position to release the latch;

a nail rotatable to a position to restrict the latch holder, or a position to release the latch by releasing the latch holder; and an isolation lever having one end connected to the shaft and another end contactable to the nail, pressed by the lever by being upwardly moved so as to contact the lever, and configured to push the nail to a position to release the latch holder when manipulating the handle to the OFF position in a state that the contact of the movable contactor and the contact of the fixed contactor are melt-adhered to each other, wherein the isolation lever is formed of an elastic material so as to push the nail when being pressed, and so as to restore to the original position when the pressure applied thereto disappears.

2. The mold cased circuit breaker of claim 1, further comprising:

a side plate configured to provide supporting substrates of both sides; and a guide pin fixed to the side plate and guiding up-down motion of the isolation lever.

3. The mold cased circuit breaker of claim 2, wherein the isolation lever is provided with a guide long hole portion configured to guide the up-down motion of the isolation lever by the guide pin.

4. A switching mechanism for a mold cased circuit breaker comprising:

a fixed contactor electrically connectable to an electric power source and an electric load of a circuit, and having a contact; a movable contactor rotatable to a position contacting the fixed contactor or a position separated from the fixed contactor; and a shaft configured to rotatably support the movable contactor, the switching mechanism comprising:

a handle configured to manually operate the circuit breaker to an ON position or an OFF position;

a lever connected to the handle so as to provide a rotation supporting point of the handle;

a trip spring capable of driving the circuit breaker to a TRIP position that the contact of the movable contactor is separated from the contact of the fixed contactor, by rotating the shaft by using elastic energy charged thereto, having an upper end supported by the handle, and configured to indicate a melt-adhered state of contacts by manipulating the handle to the TRIP position since a horizontal position of a lower end supporting point thereof in the TRIP position is discordant with a horizontal position of a rotation supporting point of the lever;

a latch configured to restrict the trip spring in a charging status of elastic energy;

an upper link having one end connected to the latch;

a lower link having an upper end connected to the upper link, and having a lower end connected to the shaft;

a toggle pin configured to connect the upper link and the lower link to each other, and configured to support a lower end of the trip spring so as to provide the lower end supporting point;

a latch holder rotatable to a position to restrict the latch or a position to release the latch;

a nail rotatable to a position to restrict the latch holder, or a position to release the latch by releasing the latch holder; and an isolation lever having one end connected to the shaft and another end contactable to the nail, pressed by the lever by being upwardly moved so as to contact the lever, and configured to push the nail to a position to release the latch holder when manipulating the handle to the OFF position in a state that the contact of the movable contactor and the contact of the fixed contactor are melt-adhered to each other, wherein the isolation lever is formed of an elastic material so as to push the nail when being pressed, and so as to restore to the original position when the pressure applied thereto disappears.

5. The switching mechanism for a mold cased circuit breaker of claim 4, further comprising:

a side plate configured to provide supporting substrates of both sides; and a guide pin fixed to the side plate and guiding up-down motion of the isolation lever.

6. The switching mechanism for a mold cased circuit breaker of claim 5, wherein the isolation lever is provided with a guide long hole portion configured to guide the up-down motion of the isolation lever by the guide pin.

* * * * *